US011851382B1

(12) United States Patent
Basom et al.

(10) Patent No.: US 11,851,382 B1
(45) Date of Patent: Dec. 26, 2023

(54) FLEXIBLE HALOCARBON PYROLANT

(71) Applicant: The United States of America as Represented by the Secretary of the Navy, Indian Head, MD (US)

(72) Inventors: Kenneth B. Basom, Waldorf, MD (US); Bryan Milani, Port Tobacco, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1096 days.

(21) Appl. No.: 16/602,212

(22) Filed: Aug. 29, 2019

(51) Int. Cl.
*C06B 27/00* (2006.01)
*C06B 21/00* (2006.01)
*C06B 47/06* (2006.01)

(52) U.S. Cl.
CPC ..... *C06B 27/00* (2013.01); *C06B 21/0033* (2013.01); *C06B 47/06* (2013.01)

(58) Field of Classification Search
None
See application file for complete search history.

(56) References Cited

U.S. PATENT DOCUMENTS 3,788,908 A * 1/1974 Hayward ..... C06B 33/00 102/513
3,970,003 A * 7/1976 Hayward ..... F42B 4/26 102/336
5,531,844 A * 7/1996 Brown ..... C06C 15/00 149/19.92
8,114,230 B1 2/2012 Basom
9,573,858 B1 2/2017 Brothers
2014/0374084 A1 12/2014 Mace et al.
2018/0372463 A1 12/2018 Granier

FOREIGN PATENT DOCUMENTS

WO WO-2009045723 * 9/2009

OTHER PUBLICATIONS

Koch, E., "Metal-Halocarbon Pyrolant Combustion", Lutradyn Energetic Materials Science & Technology, 2010. p. 79 of 358 teaches AlF3 is formed. https://epdf.tips/queue/metal-fluorocarbon-based-energetic-materials.html.

(Continued)

*Primary Examiner* — Aileen B Felton
(74) *Attorney, Agent, or Firm* — Fredric J Zimmerman

(57) ABSTRACT

The conformable pyrolant includes a fluorocarbon liquid, a fluorocarbon powder, and a micron size powdered aluminum bound together with a binder system that includes polyisobutylene and colloidal silicon dioxide. The conformable pyrolant is capable of achieving temperatures on the order 10,000° F., which will breach an ordnance item and thermally decompose an insensitive explosive fill. The conformable pyrolant also includes tungsten, wherein tungsten and silicon dioxide oxidize into fluorinated compounds, therein extending the burn and gasifying, therein enhancing ebullition and volume in general. The versatile conformable format is capable of being shaped into geometries for inclusion in ordnance items or molded into configurations for disposal of insensitive munitions.

20 Claims, 3 Drawing Sheets perfluropolyether (PFPE)

m + n = about 8 to 45
~$C_{57}F_{116}O_{20}$

(56) References Cited

OTHER PUBLICATIONS

McCollum, J., Pantoya, M., et al., "Activating Aluminum Reactivity with Fluoropolymer Coatings for Improved Energetic Composite Combustion", ACS Appl. Mater. Interfaces. https://pubs.acs.org/doi/abs/10.1021/acsami.5b05238.

Fluorine-containing oxidizers for metal fuels in energetic formulations, Defence Technology, vol. 15, Issue 1, Feb. 2019, pp. 1-22 Siva Kumar Valluri a, Mirko Schoenitz a, Edward Dreizin a, b, * a New Jersey Institute of Technology, Newark, NJ, USA b Tomsk State University, Tomsk, Russia.

Incendiary bomb developed during WWII by ICI https://en.wikipedia.org/wiki/Incendiary_device.

* cited by examiner perfluropolyether (PFPE)

m + n = about 8 to 45

~$C_{57}F_{116}O_{20}$

Example 1

1000.0 Total Composition Wt dry (g)

| | Range % | Used | grams | # of F available | # of F needed |
|---|---|---|---|---|---|
| PFPE | 50-65 | 62.0% | 620.0 | 22.4 | |
| Al | 15-25 | 20.7% | 207.0 | | 23.0 |
| PTFE | 5-12 | 9.0% | 90.0 | 2.9 | |
| SiO2 | 1.5-3 | 2.3% | 23.0 | | 1.5 |
| PIB | 2-6 | 4.0% | 40.0 | | |
| W | 1-3 | 2.0% | 20.0 | | 0.7 |
| | Total: | 100.0% | 1000.0 | 25.3 | 25.2 |

FIG. 2

| (nm) | average particle size (nm) | oxide layer thickness (nm) | particle mass alumina (%) | TMD ($g/cm^3$) | Bulk Density ($g/cm^3$) | %TMD (%) | Specific Surface Area (1/cm) |
|---|---|---|---|---|---|---|---|
| **80** | **76** | **3.9** | **36%** | **2.3** | **2.00** | **87** | **$7.9x10^5$** |
| 100 | 91 | 3.6 | 29% | 2.2 | 1.96 | 90 | $6.7x10^5$ |
| **120** | **121** | **3.6** | **23%** | **2.2** | **1.93** | **95** | **$5.0x10^5$** |
| 5500 | 5800 | 3.7 | <1% | 2.1 | 1.78 | 96 | $1.2x10^4$ |

FIG. 3

FLEXIBLE HALOCARBON PYROLANT

STATEMENT OF GOVERNMENT INTEREST

The invention described herein may be manufactured and used by or for the Government of the United States of America for Governmental purposes without the payment of any royalties thereon or therefore.

FIELD OF THE INVENTION

The invention relates generally to pyrolant compositions, and more particularly to a conformable pyrolant composition that generates exceptionally high temperatures with ebullition that facilitates intense heat transfer enabling disposal of insensitive munitions.

BACKGROUND OF THE INVENTION

Numerous efforts have been undertaken to provide an effective means of disposing Insensitive Munitions (IM) having an Insensitive Explosive (IE) fill. IE meet or exceed basic safety tests consisting of the following tests: a 28-Day Temperature and Humidity (TLH); a Vibration; 4-Day T&H; a 40-Foot Drop; pass a Cook-off; a Slow Cook-off; a Bullet Impact; a Fragment Impact; pass a Sympathetic Detonation; a Shaped Charge Jet Impact; and a Spall Impact. The tests are described in MIL-STD-2105A (Navy).

Insensitive high explosives (IHE) are used in nuclear munitions, and have to meet an even higher threshold of insensitivity. Explosives such as 2,4,6-triamino-1,3,5-trinitrobenzene (TATB) is an example of a very insensitive high explosive that is suitable for nuclear munitions. Other examples include IMX-101, which is far less likely to explode if dropped, shot at or hit by a roadside bomb during transport. Other insensitive high explosives include nitroguanidine, 1,1-diamino-2,2-dinitroethylene (aka FOX-7), and [[4,10-dinitro-2,6,8,12-tetraoxa-4,10-diazatetracyclo[5.5.0.05,9.03,11]-dodecane]] (aka TEX). High-performance insensitive high explosives like IMX-101, can resist disposal techniques that employ a large shaped charge, which produce a large shock wave.

Some well-known pyrolants, such as Thermite, typically producing higher temperatures than explosives but generating less shock, are also ineffective, as the insensitive high explosive tends to melt, rather than thermally decompose.

Pyrolant compositions produce a sustained exothermic reaction and typically consist of very fine (typically nanometric sized) metal powders, which as a fuel, and an oxidizer. Upon ignition a redox reaction is initiated. Most pyrolant compositions are not explosive, but may create brief bursts of heat and high temperature in a small area. Typically, the fuel is elemental aluminum (Al), magnesium (Mg), titanium (Ti), and/or zirconium (Zr).

Thermite, which is a mixture of aluminum (Al) and ferric oxide ($Fe_2O_3$), is one of the most commonly known military pyrolants. Thermite is capable of reaching temperatures of up to 2500° C. The Al is the fuel, and it is oxidized by $Fe_2O_3$ in a redox reaction. In the redox reaction, the Al is oxidized to $Al_2O_3$, and the iron oxide is reduced, therein forming molten iron Fe, which bubbles as formed gases, such as carbon monoxide and carbon dioxide, escape. Carbon is substantially present in all iron at various amounts. Recently, carbon monoxide was used in open hearth furnaces to reduce iron III to iron II, and ultimately to elemental iron. Oxygen and electric furnaces are currently used make steel, which is an alloy of iron, with carbon added directly to the furnace, typically prior to the melt.

Another group of pyrolants consists of combinations of metal powders and halocarbons. The high energy content of these mixtures is due to the high enthalpy of formation of the metal-halogen bond in the products of the combustion. Accordingly, fluorocarbon and chlorocarbon compounds are used in these compositions. MTV (magnesium (Mg)/Teflon™/Viton™ of DuPont) is one of the more commonly known compositions and it has found use in items such as illuminating flares and ignitors. The Teflon (polytetrafluoroethylene or PTFE) and Viton (copolymers of hexafluoropropylene (HFP) and vinylidene fluoride (VDF or VF2), terpolymers of tetrafluoro-ethylene (TFE), vinylidene fluoride (VDF) and hexafluoropropylene (HFP) as well as perfluoromethyl-vinylether (PMVE)) provide the oxidizing halogen to react with the metallic fuel. The composition is capable of producing temperatures in excess of those obtained with classical thermite mixtures reaching temperatures of nearly 3000° C. (5400° F.).

MTV compositions reach their maximum possible reaction temperatures at the stoichiometric proportions of the reactants. In practice, fuel rich compositions need to be used to achieve high ignitability and burn rate rather than optimum reaction temperature. The heat of reaction is also lowered due to the presence of atmospheric oxygen. Oxygen can impede the production of magnesium fluoride ($MgF_2$) from reaction with the halocarbons in favor of magnesium oxide (MgO), which has a lower enthalpy of formation.

Pyrolant compositions based on Al employing fluorocarbons produce aluminum fluoride ($AlF_3$) instead of aluminum oxide ($Al_2O_3$). While both species are comparable in thermodynamic stability, the fluoride compound is formed preferentially due to the higher strength of the Al—F bond. Fluorine reacts with the alumina ($Al_2O_3$), which is a passivation shell surrounding Al particles, resulting in a pre-ignition (PIR), which precedes the main Al oxidation reaction and enhances reactivity. Typically, Al-halocarbon blends are prepared with a solid oxidizer such as PFTE. Viton and Teflon are solid oxidizers, and this limits performance as neither Viton nor Teflon can readily coat the fuel, therein limiting the redox reaction rate.

Due to the aforementioned features, current pyrolants are ineffective for use as a means of disposal for IMs as they do not provide the adequate thermal insult to an EOD target due to their thermal properties. Furthermore, the previously discussed pyrolant compositions are not conformable and cannot be shaped on the EOD target. In addition, the phase transitions that occur within the EOD target explosive remove heat from the reactions of the pyrolant preventing the maximum attainable temperature from being achieved.

Explosives, for example C4, are also ineffective for the disposal of insensitive munitions as up to 40% of the mass of the explosive munition is required for disposal of the insensitive munition, and often destruction is incomplete requiring subsequent disposal procedures.

Another proposed technology generates a high temperature reaction with a perchlorate oxidizer/metal fuel mixture, but it is ineffective for the disposal of insensitive munitions for one or more of previously enumerated reasons.

SUMMARY OF THE INVENTION

The invention is a conformable pyrolant that on ignition generates exceptional high temperatures (on the order of 9930° F.) that are hot enough to ignite even the most insensitive munition. The conformable pyrolant may be deployed in a surround configuration, therein preventing movement of an insensitive explosive away from the flame front via melting.

The conformable pyrolant includes a liquid fluorocarbon, a micrometric elemental aluminum fraction with a thin passivation shell of alumina, a hydrocarbon binder system provides a wide design latitude, therein facilitating the application of the invented pyrolant for delivery of maximum thermal insult to an insensitive munition, and at least one rheological additive. The conformable pyrolant is capable of breaching an ordnance item and thermally decomposing an insensitive explosive fill. The conformable pyrolant is capable of being shaped into geometries for inclusion in ordnance items for disposal of insensitive munitions or devices.

An object of the invention is to optimize the conformable pyrolant so that maximum temperatures may be reached and may be sustained. This effect, in part, is accomplished by the inclusion of materials that form intermediates that have very high heat of formation.

A second object of the invention is to minimize the retardant effect that alumina has on the rate of burn, so that temperatures are maximized. The reader is reminded that as the weight percentage of the passivation shell increases, where the passivation shell is the layer of alumina surrounding each of the Al particles; the weight percent of elemental Al decreases, and this result is undesirable as it reduces the maximum temperatures that will be attained. Nanometer size Al particles have a much higher percent of alumina than micrometer size Al particles. Furthermore, alumina is already oxidized, and therefore is a poor fuel at best. Alumina may be significantly decreased by employing micron Al particles, as size increases so does the weight percentage of elemental Al. An increase in the weight percentage of elemental Al, can increase a maximum temperature.

A third object of the invention is inclusion of materials that enhance ebullition, wherein ebullition effectively increases the volume of the pyrolant as it burns.

A fourth object of the invention is that the process for preparing of the conformable pyrolant, on a laboratory scale, does not require any specialized equipment.

A final object of the invention is that the preparation process is safe, and the conformable pyrolant itself is safe to handle (meets MIL-STD-2105A (Navy)).

BRIEF DESCRIPTION OF THE DRAWINGS

The foregoing invention will become readily apparent by referring to the following detailed description and the appended drawings in which:

FIG. 2 illustrates the weight percentage range of the individual components and an example of the stoichiometric balance of the fluorocarbon oxidizers and the fuel; and FIG. 3 illustrates how the weight percentage of a nanometer sized aluminum powder that is alumina increases as the particle size decreases, compared to −5.5 micron aluminum powder.

DETAILED DESCRIPTION OF THE INVENTION

Figure 1:
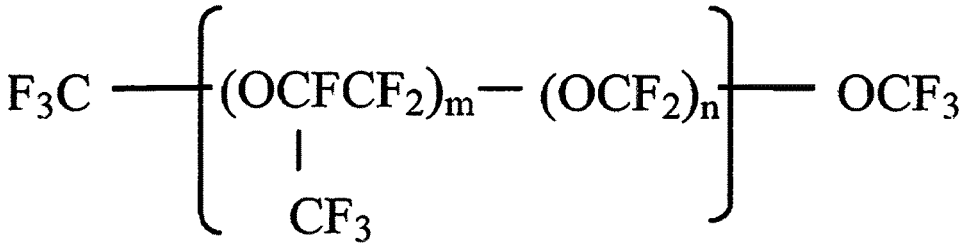
FIG. 1 illustrates the molecular structure of perfluorinated polyether (PFPE)

The invented conformable pyrolant includes a main fuel, aluminum, two minor fuels (i.e.; tungsten and polyisobutylene) and two in situ formed fuels, silicon from silicon dioxide and aluminum from alumina ($Al_2O_3$). Alumina is present as a passivation shell surrounding the Al particles. The alumina, as shown in Table 3 is a 5.5 micron diameter aluminum particle (or 5500 nm) accounts for less than one percent of the mass of the particle. By comparison, nanometer diameter particles that are 80, 100, 120 nm, respectively have an alumina mass percent weight percentage of 36%, 29% and 23%. Alumina is a very poor fuel, as it has an enthalpy of formation of =−1669.8 kJ/mol, molecular weight: 101.960=−16.37 kJ/g, which makes it a great passivation shell. Aluminum melts at 1,221° F., much below alumina melting point of 3,762° F., so unless something else occurs the elemental aluminum only becomes available when it melts. To further emphasize the impact of alumina, the enthalpy of formation of $AlF_3$ (which is sometimes defined a $Al_2F_6$), −1209.32 kJ/mol, molecular weight: 83.9767=−14.39 kJ/g; which is less exothermic than the formation of the alumina on a weight basis, so a minor amount of heat generated by fluorination will be consumed in the conversion of alumina to $AlF_3$ The main oxidizer is a perfluorinated polyether (PFPE) that is a liquid that is soluble a low molecular weight perfluoropolyether, such as (Galden Perfluorosolv® having a boiling point of about 50° C. to about 90° C. The aluminum powder, PTFE, tungsten, and silicon dioxide form slurries with petroleum ether, heptane, pentane, hexane or a combination thereof. An exemplary main oxidizer is a perfluorinated ether terminated copolymer of polymethylene oxide and polypropylene oxide, which is commercially available as Fomblin® Y LVAC 25/6. Fomblin® Y LVAC 25/6 is principally used as vacuum pump oil, as it has a very low vapor pressure in substantially a vacuum. At 25° C. (68° F.) its vapor pressure is $6\times10^{-8}$ torr, and at 100° C. (212° F.) its vapor pressure is $6\times10^{-5}$ torr. Fomblin® Y LVAC 25/6 has a molecular weight of about 3208+/−400, with an empirical formula reported to be $C_{57}F_{116}O_{20}$.

In a solvent, the perfluorinated ether terminated copolymer of polymethylene oxide and polypropylene oxide is in intimate contact with alumina. It was found that at about 600° F. that the fluorine reacts with the alumina ($Al_2O_3$) passivation shell surrounding Al particles resulting in a pre-ignition reaction (PIR). The PIB precedes the main Al oxidation reaction and enhances reactivity. A displaced oxygen likely reacts with one of the carbon atoms, which ultimately will be released as a gaseous carbon compound.

To extend the reaction, a second fluorinated compound that is an oxidizer is included as a finely ground powder of polytetrafluroethylene (PTFE), which is largely insoluble in any known solvent, and, therefore, reaction is slower until temperatures near or above the boiling point of PTFE of 620.3° F. are reached or exceeded. The second fluorinated compound is commonly known as Teflon®, which is a trademarked product of DuPont, Inc.), The PTFE powder is included in smaller quantities than the PFPE. DuPont's Teflon® powder, in one possible variation is Zonyl 1200 MP, and it has an average particle size of 3 microns. As a solid, PTFE does not contribute to the PIR. The inclusion of the second fluorinated compound as a solid oxidizer, would initially limit performance by limiting the fuel-oxidizer surface area, but upon melting, becomes an excellent oxidizer and extend the burn time of the conformable pyrolant.

Tungsten is one of the two minor fuels, and it is included as it preferentially fluorinates forming $WF_6$. It has an enthalpy of formation −1748.37 kJ/mol, molecular weight: 297.83=−5.86 kJ/g. While its molar enthalpy of formation is very high, on a weight percent basis it is low compared to $AlF_3$. Recall aluminum fluoride's enthalpy of formation is −1209.32 kJ/mol, molecular weight: 83.9767=−14.39 kJ/g. Tungsten itself has an atomic mass of 183.84, as compared to aluminum's atomic mass of 26.9. Tungsten does have a very high boiling point of 10,030° F., so it will persist until it is fluorinated or reacts with something else. Tungsten hexafluoride ($WF_6$) boils at only 62.78° F., so it will gasify, contributing to the ebullition. Tungsten is not inclined to oxidize and has no passivation shell. In the presence of PTFE and Al it can also form $W_2C$ and WC.

The second minor fuel is also the binder. The binder is polyisobutylene (PIB), and it is soluble in the solvent and the solution. A source of a suitable PIB is BASF Corporation sold under the tradename Oppanol®. Oppanol® is available in a number of grades. N150 and N100 are preferred. N150 has a molecular weight (Mv) of $4\times10^6$ g/mole. N100 has a molecular weight (Mv) of $1\times10^6$ g/mole. Oppanol® is also available in a wide range of medium and high molecular weights. The PIB binds the components of the pyrolant into a tacky solid conformable mixture. As a pure hydrocarbon, PIB will burn via oxygen generating traditional oxidative combustion products. As discussed below, it can also react with tungsten forming a carbide. Its total contribution to the heat is minimal, but it does generate very hot spots, which sustain the redox reaction.

The carbon and hydrogen of PIB reacts with the formed and ambient oxygen to form carbon dioxide, carbon monoxide, water, and various carbon compounds. Tungsten reacts with carbon to form $W_2C$ and/or WC. As previously noted, $WF_6$ is thought to be more common.

Oxygen is released in situ when the PFPE reacts, the alumina is fluorinated, and when the silicon dioxide is fluorinated.

Silicon dioxide is a rheology modifier sufficient to provide increased thixotropic performance, increase resistance to sagging, and minimize separation of the binder from the pyrolant, wherein the conformability or plasticity is comparable to the well-known explosive C4. The rheology modifier is preferably a colloidal grade of amorphous silicon dioxide. The minimum plasticity is 0.018 according to mil-std-650 211.1.

In prepared samples, the conformable pyrolant was pressed into a disk about the size of a quarter. It is at least as tacky as the plastic explosive C4. The conformable pyrolant is capable of breaching an ordnance item and thermally decomposing an insensitive explosive fill. The conformable pyrolant can be shaped into geometries for inclusion in ordnance items for disposal of insensitive munitions or devices.

During the redox reaction the silicon dioxide is reduced to elemental silicon, the first in situ fuel, which is then oxidized to SiF4. The enthalpy of formation is −1615.0 kJ/mol, molecular weight: 104.0791=−15.5 kJ/g; therein extending the burn. The resulting $SiF_4$ has a boiling point of −85° F., and as a gas it will add to the ebullition.

As previously discussed, once the PIR starts the alumina passivation shell is converted to Al (the second in situ fuel) which is then fluorinated into $AlF_3$ or $Al_2F_6$. In either case ($AlF_3$ or $Al_2F_6$)), fluorination of aluminum does not generate gas, as both $AlF_3$ or $Al_2F_6$ are ionic and do not gasify.

Due to the aforementioned features, current pyrolants are ineffective for use as a means of disposal for IMs as they do not provide the adequate thermal insult to a target due to their thermal properties or inflexible format. In addition, the phase changes that occur within the explosive also remove heat from the reactions with the pyrolant preventing the maximum attainable temperature from being achieved.

Actual Process (Method): A conformable pyrolant was prepared as follows:

At room temperature, a volume of a solvent, where the solvent was selected from the group consisting of: a low molecular weight perfluoropolyether, such as (Galden Perfluorosolv®, having a boiling point of about 50° C. to about 90° C., petroleum ether, heptane, pentane, hexane or a combination thereof was added to a container, for example a beaker. Perfluorosolv® is a low molecular weight perfluoropolyether solvent having a boiling point of about 50° C.-90° C., depending on the grade (PFS2 or PFS1). Galden Perfluorosolv® is a trademarked product of Solvay Solexis, Inc. The solvent was stirred on a magnetic stir plate to facilitate the mixing of the other materials. They include micron sized aluminum powder having a particle diameter of about 5 microns with less than 1% weight of alumina, a perfluorinated polyether (PFPE) that is a liquid, such as Fomblin Y LVAC 25/6, which is a perfluorinated polyether (PFPE) of a perfluorinated terminated copolymer of perfluorinated polymethylene oxide and perfluorinated polypropylene oxide having a molecular weight of about 3208+/−400. As noted before Fomblin® Y LVAC 25/6 has a very low vapor pressure. At 25° C. (68° F.) its vapor pressure is $6\times10^{-8}$ torr, and at 100° C. (212° F.) its vapor pressure is $6\times10^{-5}$ torr.

Fomblin® Y LVAC 25/6 is a trademarked product of Solvay Solexis and is sold by SPI Supplies, Inc. Fomblin® Y LVAC 25/6 dissolved in the solvent forming a solution. The formula for Fomblin® Y LVAC 25/6 is illustrated in FIG. 1. Its empirical formula is reported to be $C_{57}F_{116}O_{20}$.

Also added was another fluorinated compound, a polytetrafluorethylene (PTFE) (Teflon® is a trademarked product of DuPont, Inc.), was added as an insoluble powder in much smaller quantities than the PFPE. It was added as an insoluble powder in much smaller quantities than the PFPE. An exemplary powder is Zonyl® 1200 MP, which has an average particle size of 3 microns. Merck lists that Teflon® has at least 20,000 tetrafluoroethylene units in PTFE. Merck also states that Teflon is soluble in perfluorinated kerosene, but its percent solubility is relatively low, and perfluorinated kerosene cannot be readily removed.

Also added is a soluble binder. The binder is polyisobutylene (PIB). A source of the PIB is BASF Corporation sold under the tradename Oppanol®. Oppanol® is available in a number of grades. N150 and N100 are exemplary materials. N150 has a molecular weight (Mv) of $4\times10^6$ g/mole. N100 has a molecular weight (Mv) of $1\times10^6$ g/mole. Oppanol® is also available in a wide range of medium and high molecular weights.

Additionally, micron size Tungsten powder and colloidal silicon dioxide powder also were added. The colloidal silicon dioxide powder has a very strong thickening effect, as the primary particle size is about 5-50 nm, which is very fine, and its forms stable colloidal suspensions. The silicon dioxide is, in an exemplary embodiment, amorphous, not crystalline.

The mixture was stirred until the composition was uniform;

In the last step, the solvent was evaporated, removing the solvent, there in forming a dry pyrolant that is conformable.

The solvent provides several very important properties. Firstly, it displaces the air in the dry powders, where air is entrained in the aluminum powder, the silicon dioxide powder, the Teflon powder, and the Tungsten powder. Secondly, the solvent provides a medium for the PFPE to be diluted and dissolved forming a solution, which may come into intimate contact with the alumina coating the surface of the aluminum.

The components are added within the following weight percentage range as given in the Table on FIG. 2.

The inventors observed that there was complete incorporation of the components, yielding a conformable consistency that may be rolled into sheets that are even tackier than C4, having a minimum plasticity of 0.018 according to mil-std-650 211.1.

Test disks about the size of a quarter were prepared for laboratory testing. It is anticipated that because of the tack, sheets of the conformable pyrolant may be laminated and/or formed into various shapes to optimize the defeat of IM. The inventors have previously suggested that a surround configuration may be the most effective for the destruction of some ordnance.

The weight percent range of PFPE is from about 50% to about 65% of the total weight percent. The weight percent range of the about 5 microns Al powder is from about 15% to about 25% of the total weight percent. The weight percent range of the PTFE is from about 5% to about 12% of the total weight percent. The weight percent of the silicon dioxide powder is from 1.5% to about 3% of the total weight percent. The weight percent range of the PIB is from about 2% to about 6% of the total weight percent. The weight percent range of the Tungsten is from about 1% to about 3% of the total weight percent.

The temperature achieved by the compositions exceeds the melting point of any alloy used in ordnance items and the decomposition temperatures of any insensitive fill and should provide an effective technology for disposal of such materials.

While other pyrolants are capable of superior thermal performance, the malleable format of the composition is uniquely capable of almost any geometry providing for use in "point blank" applications as well as configuration in ordnance items.

The realized compositions meet the goals of providing an extremely high performing pyrolant in a versatile, conformable format providing for potential use in the disposal of IMs.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A conformable pyrolant, comprising:

a predominately micron size aluminum powder having an oxidized surface layer of alumina;

a perfluorinated polyether (PFPE) being in a liquid phase with a vapor pressure;

a polytetrafluoroethylene (PTFE) being in a powder form;

a predominately micron size powder of elemental tungsten;

a polyisobutylene (PIB); and a colloidal silicon dioxide powder, wherein the micron size powder of elemental tungsten is present at no more than about 3% of a total compositional weight percentage of 100%.

2. The conformable pyrolant according to claim 1, wherein stoichiometrically there are about three fluorine atoms for every aluminum atom.

3. The conformable pyrolant according to claim 1, wherein the perfluorinated polyether is a perfluorinated ether terminated copolymer of polymethylene oxide and polypropylene oxide.

4. The conformable pyrolant according to claim 1, wherein the adiabatic flame temperature is about 9930° F.

5. The conformable pyrolant according to claim 1, wherein the colloidal silicon dioxide powder has a particle size that is predominately about 5 nm to about 50 nm.

6. The conformable pyrolant according to claim 1, wherein the PIB has a gram molecular weight in the range of $1\times10^6$ g/mole to about $4\times10^6$ g/mole.

7. The conformable pyrolant according to claim 1, wherein the PFPE is present from about 50% to about 65% of a total weight percentage of 100%.

8. The conformable pyrolant according to claim 1, wherein the micron sized aluminum powder is present from about 15% to about 25% of a total weight percentage of 100%.

9. The conformable pyrolant according to claim 1, wherein the PTFE is present from about 5% to about 12% of a total weight percentage of 100%.

10. The conformable pyrolant according to claim 1, wherein the colloidal silicon dioxide powder is present from 1.5% to about 3% of a total weight percentage of 100%.

11. The conformable pyrolant according to claim 1, wherein the PIB is present from about 2% to about 6% of a total weight percentage of 100%.

12. A process for preparing a conformable pyrolant, comprising:

adding to a container a volume of a solvent at room temperature, whereon the solvent is selected from at least one of a low molecular weight perfluoropolyether having a boiling point of about 50° C. to about 90° C., petroleum ether, heptane, pentane, and hexane;

stirring the solvent therein facilitating addition of a quantity of a micron size aluminum powder having an oxidized surface layer of alumina, therein forming a slurry in the solvent;

adding a perfluoropolyether being a liquid with a very low vapor pressure;

mixing the perfluoropolyether in the solvent;

adding a predominately micron size powder of elemental tungsten;

dispersing the micron size aluminum powder and predominately micrometric powder of elemental tungsten, wherein the perfluoropolyether is coated onto at least a surface of the micron size aluminum powder and the predominately micron size powder of elemental tungsten;

adding a powder of polytetrafluoroethylene to the container, and dispersing it in the solvent;

adding a polyisobutylene polymer, which is a soluble binder that dissolves in the solvent;

adding a rheology agent selected from a colloidal silicon dioxide powder, which imparts stiffness;

mixing until homogeneous; and drying off the solvent, therein isolating the conformable pyrolant.

13. A conformable pyrolant having a total weight percent of 100%, comprising:

a micron size aluminum powder including an oxidized surface layer of alumina, wherein the micron size aluminum powder is about 15% to about 25% by weight of the total weight percent;

a perfluorinated polyether (PFPE) being a liquid with a vapor pressure, wherein the PFPE is about 50% to about 65% by weight of the total weight percent;

a polytetrafluoroethylene (PTFE) being in a powder form, wherein the PTFE is about 5% to about 12% by weight of the total weight percent;

a micron size powder of elemental tungsten, wherein the micron size powder of elemental tungsten is about 1% to about 3% by weight of the total weight percent of 100%;

a polyisobutylene, wherein the polyisobutylene is about 2% to about 6% by weight of the total weight percent; and a colloidal silicon dioxide powder, wherein the colloidal silicon dioxide powder is about 1.5% to about 3% by weight of the total weight percent.

14. The conformable pyrolant according to claim 13, wherein said conformable pyrolant includes a minimum plasticity of 0.018.

15. The conformable pyrolant according to claim 1, wherein the alumina is a passivation shell surrounding the micron sized aluminum powder.

16. The conformable pyrolant according to claim 1, wherein the PFPE includes a first vapor pressure, and wherein at 25° C. (68° F.) the first vapor pressure is $6\times10^{-8}$ torr.

17. The conformable pyrolant, wherein the PFPE includes a second vapor pressure, and wherein at 100° C. (212° F.) the second vapor pressure is $6\times10^{-5}$ torr.

18. The conformable pyrolant, wherein the PFTE includes an average particle size of 3 microns.

19. The conformable pyrolant, wherein the polyisobutylene includes a first molecular weight (Mv) of $4\times10^{6}$ g/mole.

20. The conformable pyrolant, wherein the polyisobutylene includes a first molecular weight (Mv) of $1\times10^{6}$ g/mole.

* * * * *